US009846402B2

(12) United States Patent
Numazu et al.

(10) Patent No.: US 9,846,402 B2
(45) Date of Patent: Dec. 19, 2017

(54) STATIC CHARGE ELIMINATOR AND IMAGE FORMING SYSTEM

(71) Applicant: CASIO COMPUTER CO., LTD., Tokyo (JP)

(72) Inventors: Toshihiko Numazu, Saitama (JP); Yasuhiro Tsuyuki, Tachikawa (JP)

(73) Assignee: CASIO COMPUTER CO., LTD. (JP)

( * ) Notice: Subject to any disclaimer, the term of this patent is extended or adjusted under 35 U.S.C. 154(b) by 0 days.

(21) Appl. No.: 15/223,230

(22) Filed: Jul. 29, 2016

(65) Prior Publication Data

US 2017/0090358 A1 Mar. 30, 2017

(30) Foreign Application Priority Data

Sep. 28, 2015 (JP) ..... 2015-189291

(51) Int. Cl.
*G03G 15/00* (2006.01)

(52) U.S. Cl.
CPC ..... *G03G 15/6573* (2013.01)

(58) Field of Classification Search
CPC ..... G03G 15/6573; G03G 15/6517; G03G 15/652; G03G 15/65; G03G 2215/00455; G03G 2215/00654
See application file for complete search history.

(56) References Cited

U.S. PATENT DOCUMENTS 4,307,432 A 12/1981 Nishikawa
5,461,470 A * 10/1995 De Cock ..... G03G 15/238 101/180
2002/0034409 A1* 3/2002 Furuya ..... G03G 15/2057 399/333

(Continued)

FOREIGN PATENT DOCUMENTS

JP 55-083199 A 6/1980
JP H2-23384 A 1/1990

(Continued)

OTHER PUBLICATIONS

Office Action dated Jan. 26, 2017, issued in corresponding Japanese Patent Application No. 2015-189291 and English translation of the same. (10 pages).

*Primary Examiner* — Clayton E Laballe
*Assistant Examiner* — Ruifeng Pu
(74) *Attorney, Agent, or Firm* — Fitch Even Tabin & Flannery LLP

(57) ABSTRACT

A static charge eliminator includes an abutment member which abuts on a print target medium so as to eliminate static charge on a lower flow side than a position where the print target medium separates from and comes in contact with a predetermined roller on a conveyance path of the print target medium, and a supporting member which supports the abutment member such that the abutment member rotates around a rotation axis of the roller, in which the supporting member rotates while following a change in a pressing force from the print target medium via the abutment member which occurs when a winding angle using the position where the print target medium separates from and comes in contact with the roller as a reference point is changed in accordance with a winding amount of the print target medium.

17 Claims, 6 Drawing Sheets

(56) References Cited

U.S. PATENT DOCUMENTS

| | | | | |
|---|---|---|---|---|
| 2014/0064747 | A1* | 3/2014 | Numazu | G03G 15/5062 399/19 |
| 2015/0177666 | A1* | 6/2015 | Numazu | B65H 18/026 399/397 |
| 2016/0041515 | A1* | 2/2016 | Numazu | G03G 15/652 399/384 |
| 2016/0216653 | A1* | 7/2016 | Yajima | G03G 15/2017 |
| 2016/0236891 | A1* | 8/2016 | Numazu | G03G 15/6529 |

FOREIGN PATENT DOCUMENTS

| | | | |
|---|---|---|---|
| JP | H06-183628 | A | 7/1994 |
| JP | 2013-200357 | A | 10/2013 |
| JP | 2015-011046 | A | 1/2015 |
| JP | 2015-060208 | A | 3/2015 |

* cited by examiner

STATIC CHARGE ELIMINATOR AND IMAGE FORMING SYSTEM

CROSS-REFERENCE TO RELATED APPLICATION

This application is based upon and claims the benefit of priority from the prior Japanese Patent Application No. 2015-189291, filed Sep. 28, 2015, the entire contents of which are incorporated herein by reference.

BACKGROUND OF THE INVENTION

1. Field of the Invention

The present invention relates to a static charge eliminator and an image forming system.

2. Description of the Related Art

Conventionally, there has been an electrophotographic image forming apparatus. Generally, this image forming apparatus equally charges and initializes a photosensitive drum in a developing device, forms a latent image on the photosensitive drum by optical writing, develops this latent image to a toner image, directly or indirectly transfers the toner image to a print target medium, and causes a fixing device to fix the toner image.

Here, electric charge is easily accumulated in the print target medium to be conveyed within the image forming apparatus. If the electric charge is only eliminated via a shaft in a roller used for the conveyance, the electric charge cannot be completely eliminated. Thus, static charge elimination members such as static charge elimination brushes are arranged in several areas on the conveyance path of the print target medium in the image forming apparatus.

The print target medium is charged with the largest amount of electric charge when it separates from a conveyance belt or a conveyance roller. Accordingly, a static charge elimination member may often be arranged just behind the conveyance roller. That is, the static charge elimination member is arranged with high frequency just behind an ejection (conveyance) roller into which the print target medium is finally ejected, as disclosed in Japanese Patent Application Laid-Open (Kokai) Publication No. 02-023384.

In the above-described image forming apparatus, a long sheet, which is not cut, may be used as the print target medium. When the long sheet after printing is to be wound, the ejection direction of the ejected long sheet is changed by a reversing unit installed on the lower flow side in the sheet ejection of the image forming apparatus, a tip end portion of the ejected long sheet is then stuck once to a winding core (paper core) mounted on a winding shaft in a winding device, and then a winding operation is started.

However, when the ejected long sheet is to be wound by the winding device, an angle at which the long sheet is conveyed greatly changes depending on the length (the winding diameter) of the long sheet wound around the winding shaft. In such a case, the static charge elimination member fixedly arranged cannot follow the movement (the conveyance angle) of the wound long sheet. Therefore, static charge cannot be reliably eliminated.

SUMMARY OF THE INVENTION

An object of the present invention is to stably eliminate static charge from a print target medium to be conveyed at varying angles.

In accordance with one aspect of the present invention, there is provided a static charge eliminator comprising: an abutment member which abuts on a print target medium so as to eliminate static charge on a lower flow side than a position where the print target medium separates from and comes in contact with a predetermined roller on a conveyance path of the print target medium; and a supporting member which supports the abutment member such that the abutment member rotates around a rotation axis of the roller, wherein the supporting member rotates while following a change in a pressing force from the print target medium via the abutment member which occurs when a winding angle using the position where the print target medium separates from and comes in contact with the roller as a reference point is changed in accordance with a winding amount of the print target medium.

In accordance with another aspect of the present invention, there is provided an image forming system comprising: an abutment member which abuts on a print target medium so as to eliminate static charge on a lower flow side than a position where the print target medium separates from and comes in contact with a predetermined roller on a conveyance path of the print target medium; a supporting member which supports the abutment member such that the abutment member rotates around a rotation axis of the roller; and a winding section which is used for winding the print target medium, wherein the supporting member rotates while following a change in a pressing force from the print target medium via the abutment member which occurs when a winding angle using the position where the print target medium separates from and comes in contact with the roller as a reference point is changed in accordance with a winding amount of the print target medium by the winding section.

In accordance with another aspect of the present invention, there is provided an image forming system comprising: a static charge elimination member which abuts on a print target medium on a lower flow side than a position where the print target medium separates from and comes in contact with a predetermined roller on a conveyance path of the print target medium; a supporting member which supports the static charge elimination member such that the static charge elimination member rotates around a rotation axis of the roller; a winding section which is used for winding the print target medium, wherein the supporting member rotates while following a change in a pressing force from the print target medium via the static charge elimination member which occurs when a winding angle using the position where the print target medium separates from and comes in contact with the roller as a reference point is changed in accordance with a winding amount of the print target medium by the winding section.

According to the present invention, static charge can be stably eliminated from a print target medium to be conveyed at varying angles.

Advantages of the invention will be set forth in the description which follows, and in part will be obvious from the description, or may be learned by practice of the invention. The Advantages of the invention may be realized and obtained by means of the instrumentalities and combinations particularly pointed out hereinafter.

BRIEF DESCRIPTION OF THE DRAWINGS

The accompanying drawings, which are incorporated in and constitute apart of the specification, illustrate embodiments of the invention, and together with the general description given above and the detailed description of the embodiments given below, serve to explain the principles of the invention.

DETAILED DESCRIPTION OF THE PREFERRED EMBODIMENT

An embodiment of the present invention will hereinafter be described with reference to the drawings.

Figure 1:
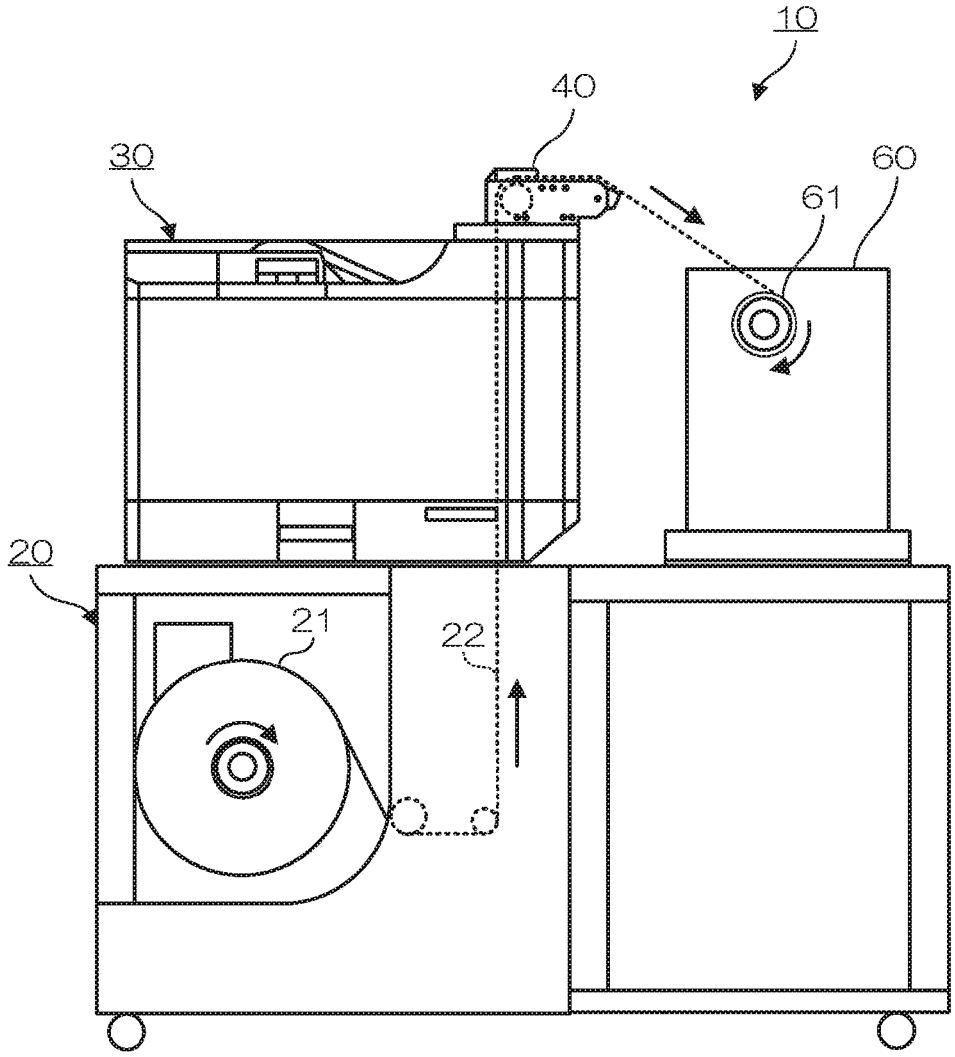
FIG. 1 is a conceptual diagram showing the entire structure of an image forming system 10 for printing on a long sheet in an embodiment of the present invention.

FIG. 1 is an overall conceptual diagram of an image forming system 10 for printing on a long sheet in an embodiment of the present invention. In FIG. 1, the image forming system 10 includes a long sheet feeding section 20, a printer body 30, and a long sheet winding section 60. The long sheet feeding section 20 is installed below the printer body 30, and a sheet feeding roll 21 is installed therein. A print target medium 22 that is a long sheet, which has been pulled out of the sheet feeding roll 21, is fed from the sheet feeding roll 21 into the printer body 30 positioned thereabove.

The printer body 30 is an electrophotographic tandem-type color image forming apparatus using a secondary transfer method, and includes a drum/developing device, a transfer belt device, an image forming unit, a fixing device, and the like (not shown). The print target medium 22, which has been printed by the printer body 30 and conveyed therefrom, is wound around a winding shaft 61 installed in the long sheet winding section 60 via a reversing unit 40. (In practice, a winding core (paper core) is mounted on the winding shaft 61, the print target medium 22 is wound therearound, and the paper core and the print target medium 22 wound in a roll shape around the paper core are removed from the winding shaft 61 when the winding ends. The winding shaft 61 and the winding core (paper core) are hereinafter collectively referred to as "winding shaft 61".) The reversing unit 40 reverses the ejected print target medium 22 and ejects the reversed print target medium 22. The ejected print target medium 22 is wound around the winding shaft 61. Here, an angle at which the print target medium 22 ejected from the reversing unit 40 is conveyed changes depending on the length (the winding diameter) of the long sheet wound around the winding shaft 61.

Figure 2B:
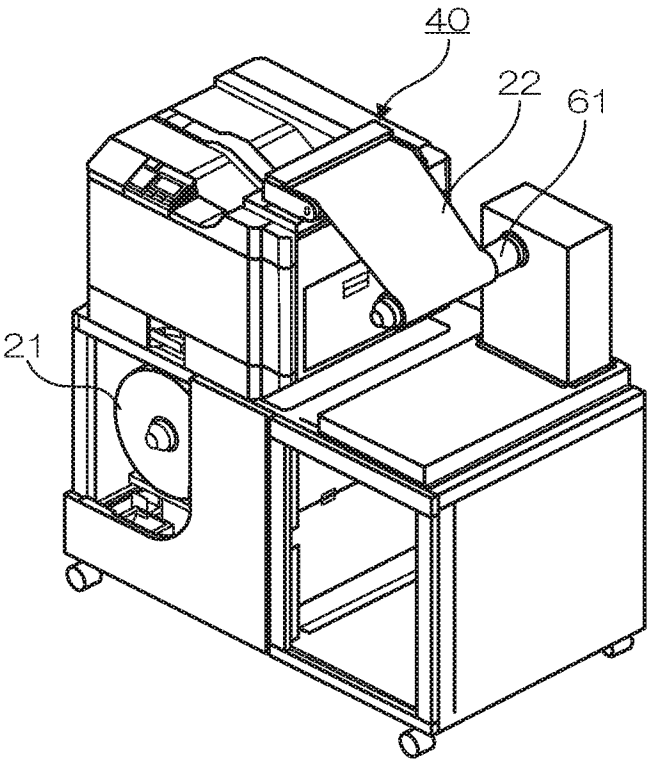
FIG. 2B is a perspective view of the structure of the image forming apparatus 10 according to the embodiment of the present invention, which shows a state where the long sheet serving as the print target medium 22 is wound around a winding shaft 61.
Figure 2A:
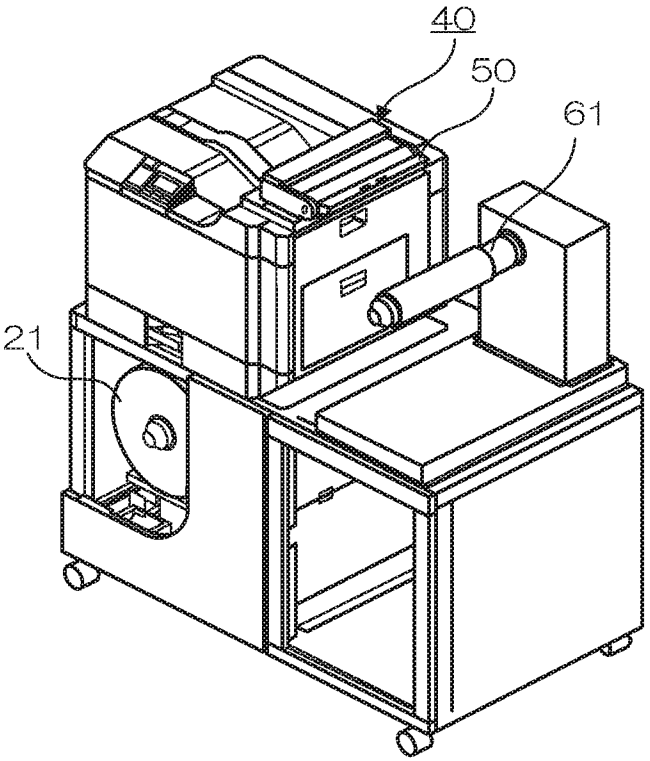
FIG. 2A is a perspective view of the structure of an image forming apparatus 10 according to the embodiment of the present invention, which shows a state where a long sheet serving as a print target medium 22 has not been ejected.

FIG. 2A and FIG. 2B are respectively perspective views each showing the appearance of the image forming system 10 according to the present embodiment. FIG. 2A shows a state where the long sheet serving as the print target medium 22 has not been ejected, and FIG. 2B shows a state where the ejected long sheet serving as the print target medium 22 is wound around the winding shaft 61 via the reversing unit 40.

The print target medium 22 is set on the winding shaft 61 prior to a printing operation. This print target medium 22, which is the long sheet, is pulled out of the sheet feeding roll 21 in the long sheet feeding section 20, fed into the printer body 30, and ejected from an ejection port of the printer body 30 along a conveyance path shown in FIG. 1. This print target medium 22 ejected from the printer body 30 is further reversed via the reversing unit 40, and ejected toward the long sheet winding section 60.

An operator manually fixes a tip end portion of the print target medium 22 ejected from the reversing unit 40 to the winding shaft 61 on the lower flow side. The print target medium 22 is set on the winding shaft 61 by the tip end portion of the print target medium 22 fed from the printer body 30 being stuck to the winding shaft 61 with a normal tape or the like. The winding may be started when the tip end portion of the print target medium 22 is stuck to the winding shaft 61 during the operation or after the tip end portion of the print target medium 22 is stuck to the winding shaft 61 with the conveyance thereof being stopped once.

The long sheet winding section 60 has a driving portion which rotates the winding shaft 61, and the print target medium 22 to be wound around the winding shaft 61 is wound under appropriate tension. Therefore, the print target medium 22 ejected from the printer body 30 is set to be always wound under appropriate tension by a clutch mechanism being provided to the driving portion of the long sheet winding section 60 so that the print target medium 22 is not set to be forcedly pulled up.

Figure 3:
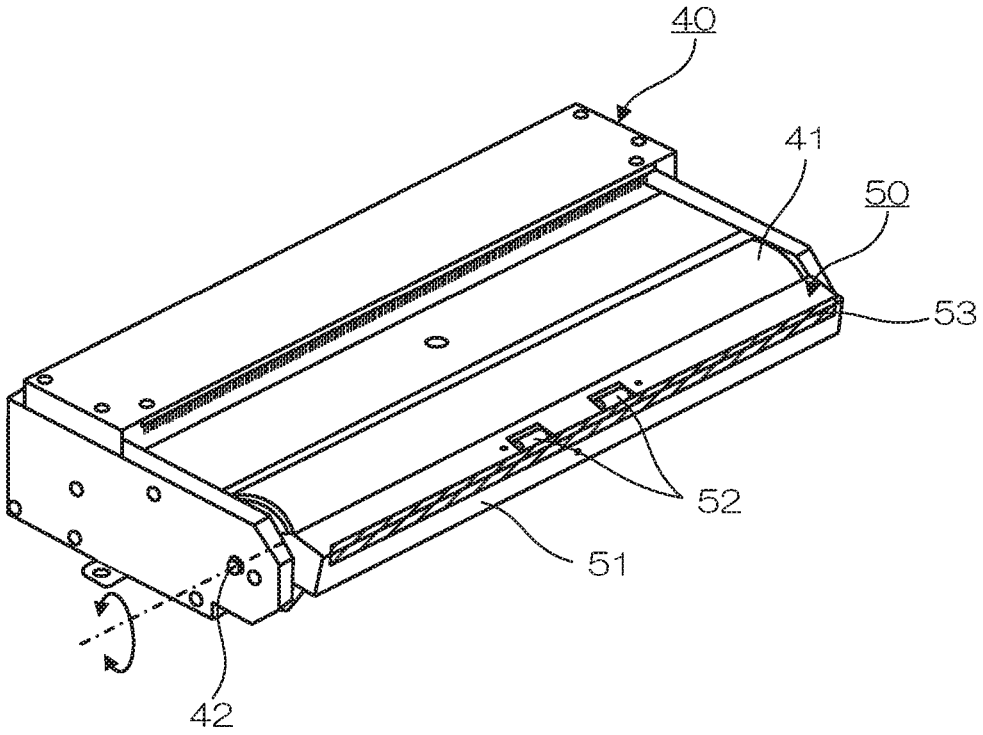
FIG. 3 is a perspective view showing the structure of a static charge eliminator 50 according to the embodiment of the present invention.

FIG. 3 is a perspective view showing the structure of the static charge eliminator 50 according to the present embodiment. In FIG. 3, the static charge eliminator 50 includes a supporting member (stay) 51, a sheet following roller 52, a static charge elimination member 53, and a spring 54 described below. The static charge eliminator 50 is arranged to rotate around a shaft 42 in an ejection roller 41 arranged in the final stage in the reversing unit 40. The sheet following roller 52, which comes in contact with and is driven by the print target medium 22 to be ejected, is arranged on the supporting member 51. The static charge elimination member 53 having a conductive property extending in the width direction of the print target medium 22 is arranged on the front surface (the tip end portion in the ejection) of the supporting member 51.

More specifically, the sheet following roller 52 and the static charge elimination member 53 are arranged as an abutment member which abuts on the print target medium 22 on the lower flow side than a position where this print target medium 22 comes in contact with and separates from the ejection roller 41 on the conveyance path of the print target medium 22.

The abutment member is arranged such that a direction in which the static charge elimination member 53 extends becomes parallel to the front surface or the rear surface of the print target medium 22 and perpendicular to the conveyance direction of the print target medium 22 at a position where the static charge elimination member 53 abuts on the print target medium 22.

When the ejected long sheet serving as the print target medium 22 is wound around the winding shaft 61, the winding angle of the print target medium 22, which changes as the winding in the long sheet winding section 60 progresses, greatly changes. Thus, the static charge elimination member 53 fixedly arranged cannot follow the movement (the conveyance angle) of the print target medium 22 to be wound. Therefore, static charge cannot be reliably eliminated.

In the present embodiment, the static charge eliminator 50 is arranged to rotate around the shaft 42 in the ejection roller 41 arranged in the final stage in the reversing unit 40 to follow the winding angle of the print target medium 22 so that the static charge elimination member 53 always abuts on the print target medium 22 ejected from the reversing unit 40.

The winding angle is a bending angle of the conveyance path when the print target medium 22 is ejected from the reversing unit 40 and directed toward the winding shaft 61 in the long sheet winding section 60, and is an angle using a position where the print target medium 22 separates from and comes in contact with the ejection roller 41 as a reference point on the conveyance path of the print target medium 22.

By the static charge eliminator 50, which rotates around the shaft 42 in the ejection roller 41 while following the winding angle of the print target medium 22 so that the static charge elimination member 53 always abuts on the print target medium 22 ejected from the reversing unit 40, being arranged in an outlet of the reversing unit 40 as described above, static charge can be stably eliminated from the print target medium 22 to be conveyed at varying angles.

Figure 4A:
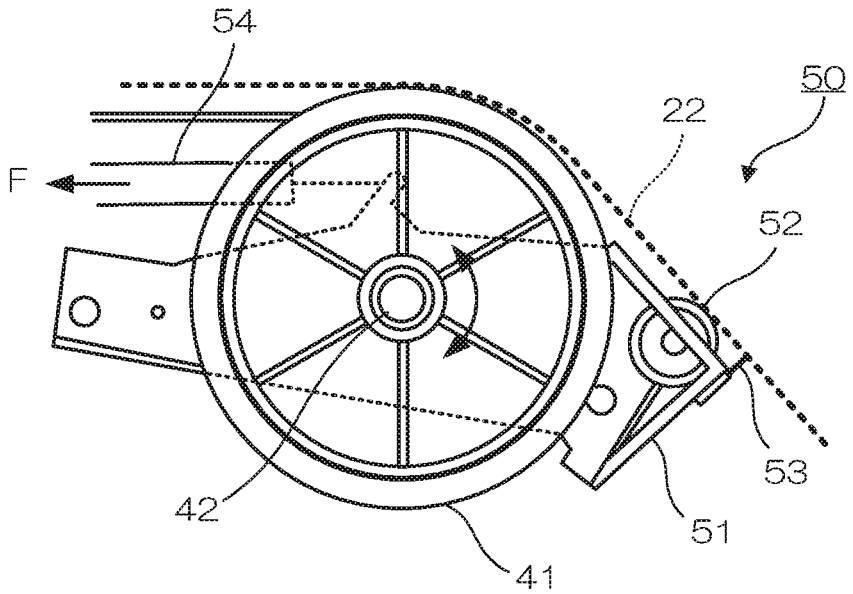
FIG. 4A is a cross-sectional view of the structure and the operation of the static charge eliminator 50 according to the embodiment of the present invention, which shows a state where a winding angle is relatively large.
Figure 4B:
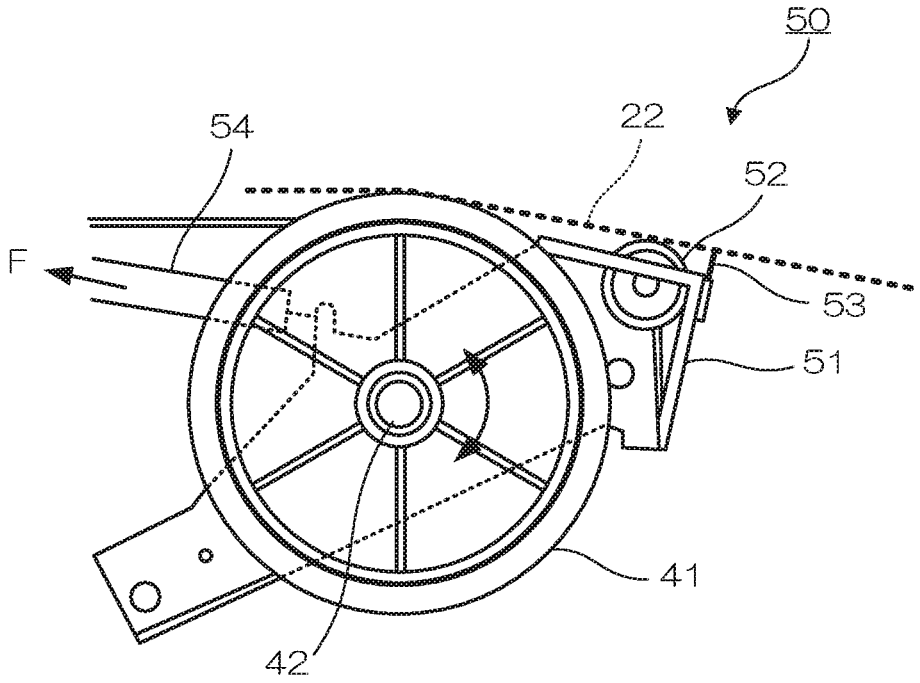
FIG. 4B is a cross-sectional view of the structure and the operation of the static charge eliminator 50 according to the embodiment of the present invention, which shows a state where a winding angle is relatively small.

FIG. 4A to FIG. 4B are respectively cross-sectional views each showing the structure and the operation of the static charge eliminator 50 according to the present embodiment. The supporting member 51 in the static charge eliminator 50 is structured to be rotatable around the shaft 42 in the ejection roller 41, as shown in FIG. 4A and FIG. 4B. The supporting member 51 is pulled by the spring 54 in the direction opposite to the conveyance direction of the print target medium 22.

More specifically, the spring 54 applies an urging force, which is exerted in a direction opposite to a direction in which the ejection roller 41 is driven to rotate when the print target medium 22 is conveyed, to the supporting member 51 as an urging member.

A pulling force by the spring 54 is adjusted so that the contact pressure of the sheet following roller 52 (or the static charge elimination member 53) with the print target medium 22 is in a predetermined range. More specifically, the pulling force is adjusted to apply a sufficient restoring force to restore the supporting member 51 to a predetermined angle (slightly above a position where the winding angle reaches its minimum) while following the winding angle of the print target medium 22.

As a result, the static charge eliminator 50 rotates around the shaft 42 in the ejection roller 41 while following a change in a pressing force from the print target medium 22 via the sheet following roller 52 (or the static charge elimination member 53) which occurs along with a change in the winding angle of the print target medium 22. The sheet following roller 52 is arranged in the upper part of the supporting member 51 and near the static charge elimination member 53 so as to come in contact with the print target medium 22 ejected from the ejection roller 41. Thus, a distance and an angle between the static charge elimination member 53 and the print target medium 22 become constant.

As shown in FIG. 4A, when the long sheet serving as the print target medium 22 has a large winding angle (is deeply wound), the supporting member 51 in the static charge eliminator 50 is inclined greatly (downward). On the other hand, as shown in FIG. 4B, when the long sheet serving as the print target medium 22 has a small winding angle (is shallowly wound), the slope of the supporting member 51 in the static charge eliminator 50 is gentle. In either case, the static charge elimination member 53 always comes in contact with the lower surface of the print target medium 22.

As described above, the static charge eliminator 50 is arranged to rotate around the shaft 42 in the ejection roller 41 while following the winding angle of the print target medium 22. As a result of this structure, the static charge elimination member 53 always comes in contact with the lower surface of the print target medium 22, whereby static charge can be reliably eliminated. Also, by the sheet following roller 52 being arranged near the static charge elimination member 53, the distance and the angle between the static charge elimination member 53 and the print target medium 22 can be made always constant. As a result, the static charge elimination member 53 has a constant static charge elimination effect even when the winding angle of the print target medium 22 is changed, whereby static charge can be stably eliminated.

Figure 5A:
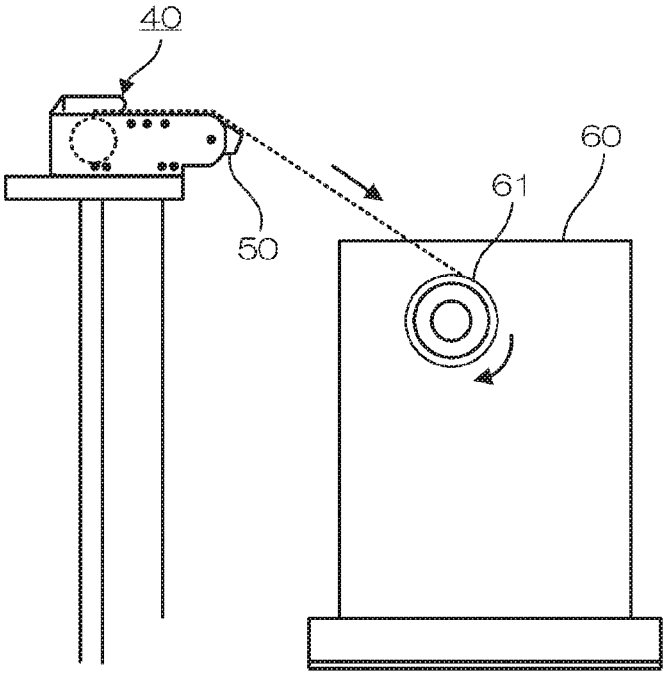
FIG. 5A is a conceptual diagram for explaining a winding operation (right winding) using a reversing unit 40 in the embodiment of the present invention, which shows a state where a winding angle is relatively large because a winding amount of the print target medium 22 around a winding shaft 61 is still small.
Figure 5B:
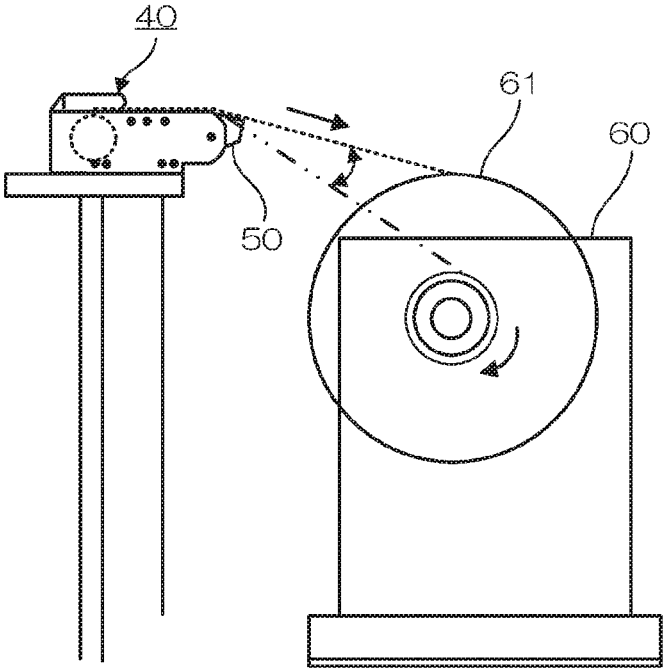
FIG. 5B is a conceptual diagram for explaining a winding operation (right winding) using the reversing unit 40 in the embodiment of the present invention, which shows a state where a winding angle has become relatively small because a winding amount of the print target medium 22 around the winding shaft 61 has become large.

FIG. 5A and FIG. 5B are respectively conceptual diagrams for explaining a winding operation (right winding) using the reversing unit 40 according to the present embodiment. In a case where the print target medium 22 that is the long sheet is wound right (in the clockwise direction in the drawing) around the winding shaft 61, it has a large winding angle (is deeply wound) in the beginning of the winding as shown in FIG. 5A. In the end of the winding, the wound print target medium 22 has a small winding angle (is shallowly wound) because its diameter may be a maximum of 320 mm, as shown in FIG. 5B.

The static charge eliminator 50 according to the present embodiment rotates around the shaft 42 in the ejection roller 41 while following the winding angle of the print target medium 22. Accordingly, the static charge elimination member 53 always comes in contact with the lower surface of the print target medium 22 ejected from the reversing unit 40, whereby static charge can be reliably eliminated.

Figure 6A:
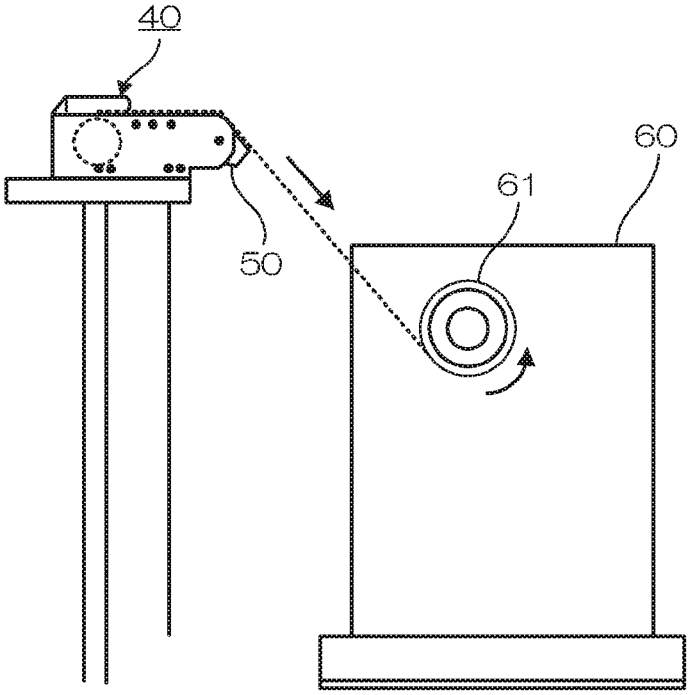
FIG. 6A is a conceptual diagram for explaining a winding operation (left winding) using the reversing unit 40 in the embodiment of the present invention, which shows a state where a winding angle is relatively large because a winding amount of the print target medium 22 around the winding shaft 61 is still small.
Figure 6B:
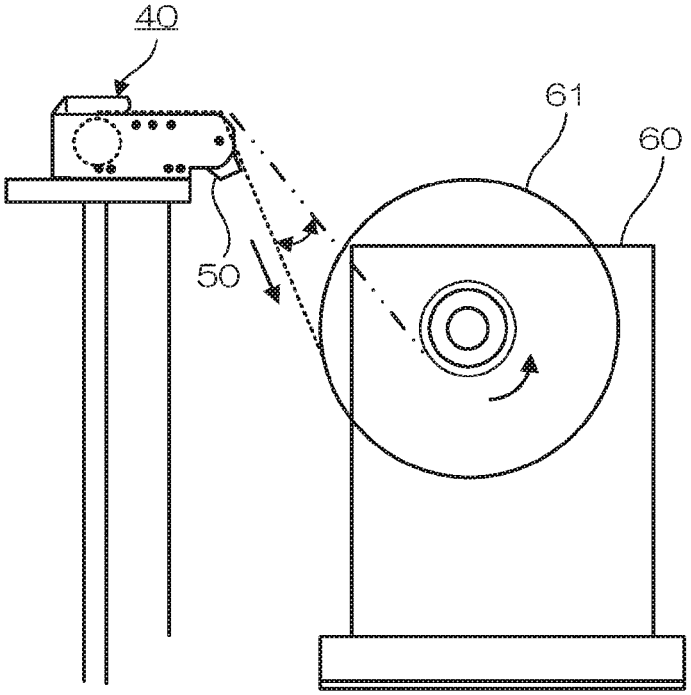
FIG. 6B is a conceptual diagram for explaining a winding operation (left winding) using the reversing unit 40 in the embodiment of the present invention, which shows a state where a winding angle has become further larger because a winding amount of the print target medium 22 around the winding shaft 61 has become large.

FIG. 6A and FIG. 6B are respectively conceptual diagrams for explaining a winding operation (left winding) using the reversing unit 40 according to the present embodiment. In a case where the print target medium 22 that is the long sheet is wound left (in the counterclockwise direction in the drawing) around the winding shaft 61, it already has a large winding angle (been deeply wound) in the beginning of the winding, as shown in FIG. 6A. In the end of the winding, the print target medium 22 has an even larger winding angle (is even more deeply wound), as shown in FIG. 6B.

That is, a difference in the winding angle of the print target medium 22 becomes significantly large in both the right winding and the left winding in the winding operation. Even if the difference in the winding angle is large as described above, the static charge eliminator 50 rotates around the shaft 42 in the ejection roller 41 while following the winding angle of the print target medium 22. Accordingly, the static charge elimination member 53 always comes in contact with the lower surface of the print target medium 22 ejected from the reversing unit 40, whereby static charge can be reliably eliminated.

According to the above-described embodiment, the static charge eliminator 50 is arranged to rotate around the shaft 42 in the ejection roller 41 while following the winding angle of the print target medium 22. As a result of this structure, the static charge elimination member 53 always comes in contact with the lower surface of the print target medium 22, whereby static charge can be reliably eliminated.

Also, according to the above-described embodiment, the sheet following roller 52 is arranged at a position where the static charge elimination member 53 always comes in contact with the lower surface of the print target medium 22 and near the static charge elimination member 53. As a result of this structure, the distance and the angle between the static charge elimination member 53 and the print target medium 22 can be made always constant. As a result, the static charge elimination member 53 has a constant static charge elimination effect even when the winding angle of the print target medium is changed, whereby static charge can be stably eliminated.

Moreover, according to the above-described embodiment, the supporting member 51 is pulled by the spring 54 in the direction opposite to the conveyance direction of the print target medium 22 so that the contact pressure of the sheet following roller 52 (or the static charge elimination member 53) with the print target medium 22 enters a predetermined range. Therefore, even when the winding angle of the print target medium 22 is changed, the static charge elimination member 53 always comes in contact with the print target medium 22 at the predetermined constant pressure, and has a constant static charge elimination effect, whereby static charge can be stably eliminated.

In the above-described embodiment, the image formation surface of the print target medium 22 is its front surface (upper surface), and therefore the sheet following roller 52 and the static charge elimination member 53 are made to abut on the rear surface (lower surface) of the print target medium 22 so as not to make the image formation surface dirty. However, they may abut on the front surface (upper surface) of the print target medium 22 because static charge is eliminated in a final ejection area after a print image is fixed to adhere to the print target medium 22. In this case where the image formation surface is the front surface of the print target medium 22, an urging force of the static charge eliminator 50 toward the print target medium 22 can also use a downward force by a weight around the supporting member 51.

Also, a static charge elimination method (a contact static charge elimination method/non-contact static charge elimination method, etc.), a distance/angle from the print target medium 22, a contact form/shape in the case of contact, and the like can be adjusted as needed by changing a positional relationship between the sheet following roller 52 and the static charge elimination member 53, their respective sizes, and/or their respective lengths depending on a material for the static charge elimination member 53, a charging amount of the print target medium 22, or the like. Moreover, depending on the shape and the characteristic of the static charge elimination member 53, a desired static charge elimination performance may be obtained even without the sheet following roller 52. In this case, the sheet following roller 52 may be excluded.

While the present invention has been described with reference to the preferred embodiments, it is intended that the invention be not limited by any of the details of the description therein but includes all the embodiments which fall within the scope of the appended claims.

What is claimed is:

1. A static charge eliminator comprising:

an abutment member which abuts on a print target medium so as to eliminate static charge, the abutment member being disposed at a downstream position in a conveyance direction of the print target medium from a position where the print target medium separates from a predetermined roller; and a supporting member which supports the abutment member such that the abutment member rotates around a rotation axis of the roller, wherein the supporting member rotates while following a change in a pressing force from the print target medium via the abutment member which occurs when a winding angle using the position where the print target medium separates from the roller as a reference point is changed in accordance with a winding amount of the print target medium.

2. The static charge eliminator according to claim 1, further comprising:

an urging member which applies to the supporting member an urging force that is exerted in a direction opposite to a direction in which the roller is driven to rotate when the print target medium is conveyed.

3. The static charge eliminator according to claim 1, wherein the abutment member is arranged to abut on a front surface or a rear surface of the print target medium on which the roller comes in contact with the print target medium.

4. The static charge eliminator according to claim 1, wherein the abutment member includes a static charge elimination member having a conductive property, and the static charge elimination member abuts on the print target medium.

5. The static charge eliminator according to claim 4, wherein the abutment member includes a roller provided to abut on the print target medium in an area between the roller and the static charge elimination member.

6. The static charge eliminator according to claim 4, wherein the static charge elimination member is arranged such that an extension direction of the static charge elimination member becomes parallel to a front surface or a rear surface of the print target medium and perpendicular to the conveyance direction of the print target medium.

7. The static charge eliminator according to claim 6, wherein the abutment member includes a plurality of rollers arranged along the extension direction of the static charge elimination member.

8. An image forming system comprising:

an abutment member which abuts on a print target medium so as to eliminate static charge, the abutment member being disposed at a downstream position in a conveyance direction of the print target medium from a position where the print target medium separates from a predetermined roller;

a supporting member which supports the abutment member such that the abutment member rotates around a rotation axis of the roller; and a winding section which is used for winding the print target medium, wherein the supporting member rotates while following a change in a pressing force from the print target medium via the abutment member which occurs when a winding angle using the position where the print target medium separates from the roller as a reference point is changed in accordance with a winding amount of the print target medium by the winding section.

9. The image forming system according to claim 8, further comprising:

an urging member which applies to the supporting member an urging force that is exerted in a direction opposite to a direction in which the roller is driven to rotate when the print target medium is conveyed.

10. The image forming system according to claim 8, wherein the abutment member is arranged to abut on a front surface or a rear surface of the print target medium on which the roller comes in contact with the print target medium.

11. The image forming system according to claim 8, wherein the abutment member includes a static charge elimination member having a conductive property, and the static charge elimination member abuts on the print target medium.

12. The image forming system according to claim 11, wherein the abutment member includes a roller provided to abut on the print target medium in an area between the roller and the static charge elimination member.

13. The image forming system according to claim 11, wherein the static charge elimination member is arranged such that an extension direction of the static charge elimination member becomes parallel to a front surface or a rear surface of the print target medium and perpendicular to the conveyance direction of the print target medium.

14. The image forming system according to claim 13, wherein the abutment member includes a plurality of rollers arranged along the extension direction of the static charge elimination member.

15. The image forming system according to claim 8, wherein the abutment member is provided to abut on the print target medium in an area between the roller and the winding section.

16. The image forming system according to claim 8, wherein the winding section is provided below the roller, and the print target medium vertically conveyed is conveyed downward after passing through the roller.

17. An image forming system comprising:

a static charge elimination member which abuts on a print target medium, the static charge elimination member being disposed at a downstream position in a conveyance direction of the print target medium from a position where the print target medium separates from a predetermined roller;

a supporting member which supports the static charge elimination member such that the static charge elimination member rotates around a rotation axis of the roller;

a winding section which is used for winding the print target medium, wherein the supporting member rotates while following a change in a pressing force from the print target medium via the static charge elimination member which occurs when a winding angle using the position where the print target medium separates from the roller as a reference point is changed in accordance with a winding amount of the print target medium by the winding section.

* * * * *